US011809124B2

(12) United States Patent
Ozawa et al.

(10) Patent No.: US 11,809,124 B2
(45) Date of Patent: Nov. 7, 2023

(54) CLEANING UNIT INCLUDING HANDLE HAVING LOCK MECHANISM FOR LOCKING CLEANING UNIT TO MAIN BODY OF IMAGE FORMING APPARATUS

(71) Applicant: Brother Kogyo Kabushiki Kaisha, Nagoya (JP)

(72) Inventors: Atsushi Ozawa, Aichi (JP); Yohei Hashimoto, Nagakute (JP); Hikaru Iino, Niwa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/806,772

(22) Filed: Jun. 14, 2022

(65) Prior Publication Data

US 2022/0413428 A1 Dec. 29, 2022

(30) Foreign Application Priority Data

Jun. 24, 2021 (JP) ..... 2021-104936

(51) Int. Cl.
*G03G 21/10* (2006.01)
*G03G 21/16* (2006.01)
*G03G 21/12* (2006.01)

(52) U.S. Cl.
CPC ..... *G03G 21/1647* (2013.01); *G03G 21/12* (2013.01); *G03G 21/169* (2013.01); *G03G 2221/1846* (2013.01)

(58) Field of Classification Search
CPC ..... G03G 21/0005; G03G 21/12; G03G 21/1647; G03G 21/169; G03G 2221/1846
See application file for complete search history.

(56) References Cited

U.S. PATENT DOCUMENTS 8,270,852 B2 * 9/2012 Ando ..... G03G 21/12 399/10
2005/0260019 A1 11/2005 Arai
2015/0132022 A1 * 5/2015 Masuda ..... G03G 21/1647 399/110

FOREIGN PATENT DOCUMENTS

JP 2006-011360 A 1/2006

* cited by examiner

*Primary Examiner* — Sophia S Chen
(74) *Attorney, Agent, or Firm* — BURR PATENT LAW, PLLC

(57) ABSTRACT

A cleaning unit is attachable to and detachable from a main body of an image forming apparatus including a photosensitive drum and a belt configured to contact the photosensitive drum. The cleaning unit includes: a frame; and a handle. The frame is configured to accommodate therein developing agent collected from the image forming apparatus. The handle includes: a pair of first parts; and a second part. Each of the pair of first parts extends from the frame in an extending direction perpendicular to an axial direction of the photosensitive drum in a state where the cleaning unit is attached to the main body. The pair of first parts includes a lock mechanism for locking the cleaning unit to the main body. The second part extends in the axial direction and connects the pair of first parts to each other.

20 Claims, 10 Drawing Sheets

CLEANING UNIT INCLUDING HANDLE HAVING LOCK MECHANISM FOR LOCKING CLEANING UNIT TO MAIN BODY OF IMAGE FORMING APPARATUS

CROSS REFERENCE TO RELATED APPLICATIONS

This application claims priority from Japanese Patent Application No. 2021-104936 filed Jun. 24, 2021. The entire content of the priority application is incorporated herein by reference.

BACKGROUND

There has been conventionally known an electro-photographic type image forming apparatus configured to form an image by transferring a toner image carried on a photosensitive drum onto a sheet. In such a conventional image forming apparatus, a cleaning unit for collecting developing agent deposited on a photosensitive drum or a transfer belt and a waste toner bottle for accommodating therein the collected developing agent are provided.

The waste toner bottle is detachably attached to a main body of the image forming apparatus, and includes a handle for a user to hold the waste tonner bottle. The handle of the waste toner bottle includes a lock mechanism for preventing detachment of the waste toner bottle from the main body.

The handle includes a pair of first parts extending from a main casing of the waste toner bottle, and a second part extending in a direction perpendicular to a direction in which the first parts extend to connect the first parts to each other. When holding the waste toner bottle, a user grasps the second part of the handle. The lock mechanism of the waste toner bottle is provided at the second part of the handle.

SUMMARY

Since the lock mechanism is provided at the second part serving as a part of the handle to be gripped by a user, the user's hand gripping the second part may cover the lock mechanism, thereby hindering operation of the lock mechanism.

In view of the foregoing, it is an object of the present disclosure to provide a cleaning unit in which a lock mechanism can be smoothly operated without hindrance to operation of the lock mechanism when a user grasps a handle including the lock mechanism, and an image forming apparatus including such the cleaning unit.

In order to attain the above and other objects, the present disclosure provides a cleaning unit attachable to and detachable from a main body of an image forming apparatus including a photosensitive drum extending in an axial direction and a belt configured to contact the photosensitive drum. The cleaning unit is capable of accommodating therein developing agent collected from the image forming apparatus. The cleaning unit includes: a frame; and a handle. The frame is configured to accommodate therein developing agent collected from the image forming apparatus. The handle includes: a pair of first parts; and a second part. Each of the pair of first parts extends from the frame in an extending direction perpendicular to the axial direction in a state where the cleaning unit is attached to the main body. The pair of first parts includes a lock mechanism for locking the cleaning unit to the main body. The second part extends in the axial direction and connects the pair of first parts to each other.

In the above configuration, since the lock mechanism is provided at the pair of first parts of the handle, a user's hand is less likely to cover the lock mechanism when the user grasps the second part of the handle. Accordingly, a sliding operation of the locking member of the lock mechanism is not hindered to enable smooth operation of the lock mechanism.

According to another aspect, the present disclosure also provides an image forming apparatus including: a main body; a photosensitive drum; a belt; and a cleaning unit. The photosensitive drum extends in an axial direction. The belt is configured to contact the photosensitive drum. The cleaning unit is attachable to and detachable from the main body. The cleaning unit includes: a frame; and a handle. The frame is configured to accommodate therein developing agent collected from the image forming apparatus. The handle includes: a pair of first parts; and a second part. Each of the pair of first parts extends from the frame in an extending direction perpendicular to the axial direction in a state where the cleaning unit is attached to the main body. The pair of first parts includes a lock mechanism for locking the cleaning unit to the main body. The second part extends in the axial direction and connecting the pair of first parts to each other.

In the above image forming apparatus, the lock mechanism is provided at the pair of first parts of the handle, and a user's hand is less likely to cover the lock mechanism when the user grasps the second part of the handle in the cleaning unit. Accordingly, a sliding operation of the locking member in the lock mechanism is not prevented to enable smooth operation of the lock mechanism.

According to still another aspect, the present disclosure also provides a cleaning unit attachable to and detachable from a main body of an image forming apparatus. The cleaning unit is capable of accommodating therein developing agent collected from the image forming apparatus. The cleaning unit includes: a frame; and a handle. The frame is configured to accommodate therein developing agent collected from the image forming apparatus. The handle includes: a pair of first parts; and a second part. Each of the pair of first parts extends from the frame in a first extending direction in a state where the cleaning unit is attached to the main body. The pair of first parts includes a locking block for locking the cleaning unit to the main body. The second part extends in a second extending direction perpendicular to the first extending direction and connects the pair of first parts to each other.

Even in the above configuration of the cleaning unit, since the locking block is provided at the pair of first parts of the handle, a user's hand is less likely to cover the locking block when the user grasps the second part of the handle. Accordingly, an operation to locking block is not hindered, thereby enabling smooth operation to the locking block.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described while referring to the accompanying drawings.

[Image Forming Apparatus]

Figure 1:
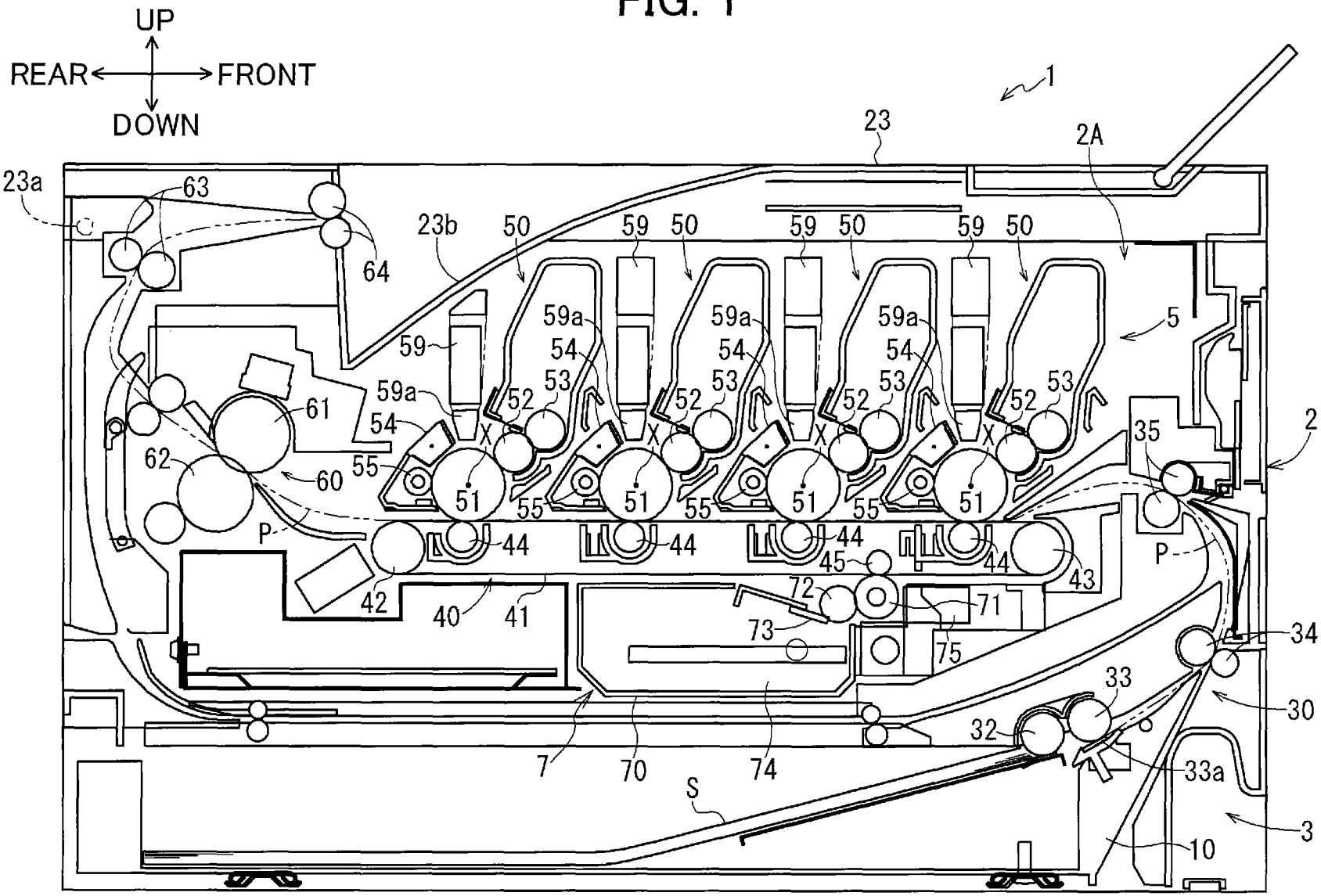
FIG. 1 is a central cross-sectional view illustrating an image forming apparatus.

An image forming apparatus 1 illustrated in FIG. 1 is an example of an image forming apparatus according to the embodiment, and is an electro-photographic type color laser printer configured to form images of multiple colors on sheets S.

In the following description, the right side and the left side in FIG. 1 are defined as the front side and the rear side of the image forming apparatus 1, respectively, the near side and the far side of the paper surface in FIG. 1 are defined as the left side and the right side of the image forming apparatus 1, respectively, and the upper side and the lower side in FIG. 1 are defined as the upper side and the lower side of the image forming apparatus 1, respectively.

The image forming apparatus 1 includes a main body 2, a sheet feeding unit 3, and an image forming unit 5. The sheet feeding unit 3 includes a sheet feed tray 10 supporting a sheet(s) S, and a sheet conveying unit 30 configured to convey the sheet(s) S. The image forming unit 5 is configured to form an image on the sheet S conveyed thereto by the sheet feeding unit 3.

The main body 2 is in a form of a substantially rectangular parallelepiped shape, and accommodates therein the sheet feeding unit 3 and the image forming unit 5. The main body 2 has an upper surface formed with an opening 2A, and includes a top cover 23 that can open and close the opening 2A.

The top cover 23 is pivotally movable about a pivot shaft 23*a* positioned at a rear end portion thereof to be movable between a closing position at which the top cover 23 closes the opening 2A and an opening position at which the top cover 23 opens the opening 2A. The top cover 23 has a sheet discharge tray 23*b* inclined downward as extending from the front side to the rear side thereof.

The sheet feeding unit 3 is disposed at a lower portion inside the main body 2 and configure to convey the sheet(s) S supported by the sheet feed tray 10 to the image forming unit 5 using the sheet conveying unit 30. The sheet feed tray 10 is slidingly movable in a front-rear direction so as to be movable between an accommodated position at which the sheet feed tray 10 is accommodated in the main body 2 and a pulled-out position at which the sheet feed tray 10 is pulled out of the main body 2 from the accommodated position.

The sheet conveying unit 30 includes a feed roller 32, a separation roller 33, a separation pad 33*a*, a pair of conveying rollers 34, and a pair of registration rollers 35. A conveying path P extending from the sheet feed tray 10 to the sheet discharge tray 23*b* through the image forming unit 5 is formed inside the main body 2.

The sheets S supported by the sheet feed tray 10 are fed to the conveying path P using the feed roller 32 while the sheets S are separated one by one using the separation roller 33 and the separation pad 33*a*. The feed roller 32 is a roller configured to convey the sheets S from the sheet feed tray 10 toward the image forming unit 5. The separation roller 33 and the separation pad 33*a* constitute a separating means for separating the sheets S supported by the sheet feed tray 10 one by one.

The sheet S fed to the conveying path P is conveyed toward the image forming unit 5 by the pair of conveying rollers 34 and the pair of registration rollers 35. The pair of registration rollers 35 restricts a position of a leading edge of the sheet S conveyed to temporality stop movement of the sheet S, and then conveys the sheet S toward the image forming unit 5 at a prescribed timing.

The image forming unit 5 is positioned above the sheet feeding unit 3, and includes four process cartridges 50 arranged in the front-rear direction. The process cartridges 50 are provided corresponding to colors of black, yellow, magenta, and cyan, respectively. Each of the process cartridges 50 is detachably attached to the main body 2. Each of the process cartridges 50 includes a photosensitive drum 51, a developing roller 52, a supply roller 53, a charger 54, and a drum cleaning roller 55.

The photosensitive drum 51 has a substantially hollow cylindrical shape centered on an axis X extending in a left-right direction, and is rotatably supported by a frame of the process cartridge 50. That is, the left-right direction defined in the present embodiment is coincident with a direction in which the axis X of the photosensitive drum 51 extends (i.e., an axial direction X of the photosensitive drum 51). The developing roller 52 extends in the left-right direction and is rotatably supported by the frame of the process cartridge 50.

The supply roller 53 is configured to supply toner (an example of developing agent) accommodated in the process cartridge 50 to the developing roller 52. The developing roller 52 is configured to supply the toner to the photosensitive drum 51.

The main body 2 also includes a plurality of exposure heads 59 configured to expose surfaces of the photosensitive drums 51 to light. Each of the exposure heads 59 is supported by the top cover 23. Four of the exposure heads 59 are provided in one-to-one correspondence with the photosensitive drums 51 to be arranged in the front-rear direction.

Each of the exposure heads 59 extends downward from the top cover 23, and has an exposure part 59*a* at a lower end portion thereof. Each of the exposure parts 59*a* is disposed at a position close to and above the corresponding one of photosensitive drums 51 when the top cover 23 is at the closing position. Each of the exposure parts 59*a* is constituted by an LED array including a plurality of LED elements arranged in the left-right direction.

The image forming unit 5 further includes a transfer belt 41, a driving roller 42, a driven roller 43, and transfer rollers 44. The transfer belt 41 is disposed below the photosensitive drums 51 so as to face the same while the conveying path P is interposed between the transfer belt 41 and the photosensitive drums 51. The transfer belt 41 is configured to contact the photosensitive drums 51. The transfer belt 41 is an example of a belt configured to contact a photosensitive drum.

The transfer belt 41 is looped over the driving roller 42 and the driven roller 43 disposed frontward of the driving roller 42. The transfer rollers 44 are disposed to face the corresponding photosensitive drums 51 to nip the transfer belt 41 therebetween. In the image forming unit 5, the transfer belt 41, the driving roller 42, the driven roller 43, and the transfer rollers 44 constitute a belt unit 40.

In the image forming unit 5, the photosensitive drums 51 uniformly charged by the chargers 54 are selectively exposed by the corresponding exposure heads 59. Accordingly, electric charges are removed from the surfaces of the photosensitive drums 51, thereby forming electrostatic latent images on the surfaces of the photosensitive drums 51.

The toner accommodated in the process cartridges 50 is positively charged between the supply rollers 53 and the developing rollers 52 to be carried on the surfaces of the developing rollers 52. A developing bias is applied to the developing rollers 52. As the electrostatic latent images formed on the photosensitive drums 51 face the developing rollers 52, the toner is supplied from the developing rollers 52 to the electrostatic latent images by a potential difference between the electrostatic latent images and the developing rollers 52. As a result, toner images are formed on the surfaces of the photosensitive drums 51.

When the sheet S fed toward the image forming unit 5 reaches the transfer belt 41, the sheet S is conveyed by the transfer belt 41 and passes between the transfer belt 41 and the photosensitive drums 51. The toner images carried on the surfaces of the photosensitive drums 51 are successively transferred onto the sheet S due to a transfer bias applied to the transfer rollers 44 when the toner images face the sheet S.

Here, some of toner may not be transferred onto the sheet S and remain on the surfaces of the photosensitive drums 51 as waste toner. The waste toner remaining on the surfaces of the photosensitive drums 51 face the corresponding drum cleaning rollers 55 in accordance with rotation of the photosensitive drums 51. At this time, the waste toner is electrically retained on surfaces of the drum cleaning rollers 55 by a drum cleaning bias applied thereto.

The transfer belt 41 in the present embodiment is configured as a conveyance belt for conveying the sheet S onto which the toner images are to be transferred. Alternatively, the transfer belt 41 may be configured as an intermediate transfer belt onto which the toner images are transferred. In this case, the toner images that have been transferred onto the transfer belt 41 are then transferred onto the sheet S.

The sheet S onto which the toner images have been transferred is then conveyed to a fixing unit 60. The fixing unit 60 includes a heat roller 61, and a pressure roller 62 in pressure contact with the heat roller 61. The toner images are thermally fixed to the sheet S while the sheet S conveyed to the fixing unit 60 passes between the heat roller 61 and the pressure roller 62.

The sheet S to which the toner images have been thermally fixed is conveyed downstream in a conveying direction from the fixing unit 60 and further conveyed by a pair of intermediate discharge rollers 63 and a pair of discharge rollers 64 positioned downstream of the intermediate discharge rollers 63, and discharged onto the sheet discharge tray 23*b*.

The image forming apparatus 1 further includes a cleaning unit 7 positioned inside the main body 2 at a position below the transfer belt 41 and above the sheet feed tray 10. The cleaning unit 7 is configured to collect the toner remaining on the transfer belt 41 and to accommodate the collected toner therein. The cleaning unit 7 is detachably attached to the main body 2.

The cleaning unit 7 includes a frame 70, a belt cleaning roller 71 as an example of a cleaning roller, a collection roller 72, and a scraping blade 73. Each of the belt cleaning roller 71 and the collection roller 72 are rotatably supported by the frame 70.

The belt cleaning roller 71 is positioned below the transfer belt 41 and faces a backup roller 45 positioned within a space encircled by the transfer belt 41. The backup roller 45 is disposed so as to contact the transfer belt 41 from the upper side thereof.

The collection roller 72 is in contact with the belt cleaning roller 71 from the rear side thereof. The scraping blade 73 is supported by the frame 70 and is disposed at a position rearward and downward of the collection roller 72. The scraping blade 73 has a front end portion in contact with a surface of the collection roller 72.

The frame 70 defines therein a storage chamber 74 configured to accommodate therein the collected waste toner. Accordingly, the cleaning unit 7 is configured to accommodate therein the waste toner collected from the image forming unit 5 of the image forming apparatus 1. The cleaning unit 7 includes a handle 75 for a user to grip the cleaning unit 7.

[Cleaning Operation for Waste Toner]

In the image forming apparatus 1, after completion of an image forming operation using the image forming unit 5, a cleaning operation is performed for collecting the waste toner retained on the drum cleaning rollers 55 using the cleaning unit 7 and storing the waste toner in the storage chamber 74.

Specifically, during the cleaning operation, the waste toner retained on the drum cleaning rollers 55 is discharged onto the surfaces of the corresponding photosensitive drums 51, and the photosensitive drums 51 are rotated. The waste toner discharged onto the surfaces of the photosensitive drum 51 faces the transfer belt 41 in accordance with rotation of the photosensitive drums 51.

When facing the transfer belt 41, the waste toner on the surfaces of the photosensitive drums 51 are transferred to the surface of the transfer belt 41 due to the transfer bias applied to the transfer rollers 44. Then, as the transfer belt 41 is circularly moved, the waste toner on the transfer belt 41 is conveyed to a portion facing the belt cleaning roller 71.

The waste toner facing the belt cleaning roller 71 is retained electrostatically on a surface of the belt cleaning roller 71 due to a belt cleaning bias applied to the belt cleaning roller 71. That is, the belt cleaning roller 71 removes the waste toner deposited on the transfer belt 41.

As described above, the belt cleaning roller 71 is a cleaning member for removing the developing agent attached to the transfer belt 41. By constituting the cleaning member by the belt cleaning roller 71 which is a roller member, toner attached to the transfer belt 41 can be continuously and easily removed.

Although the belt cleaning roller 71 which is a roller member serves as the cleaning member in the present embodiment, another configuration such as a blade-like cleaning member may be employed as the cleaning member.

The waste toner retained on the belt cleaning roller 71 is transferred electrostatically onto the collection roller 72. The waste toner that has been transferred onto the collection roller 72 is scraped by the scraping blade 73 to fall downward to be accommodated in the storage chamber 74. In this way, using the cleaning unit 7, the waste toner attached to the transfer belt 41 can be collected by the belt cleaning roller 71 and stored in the storage chamber 74.

[Main Body]

Figure 2:
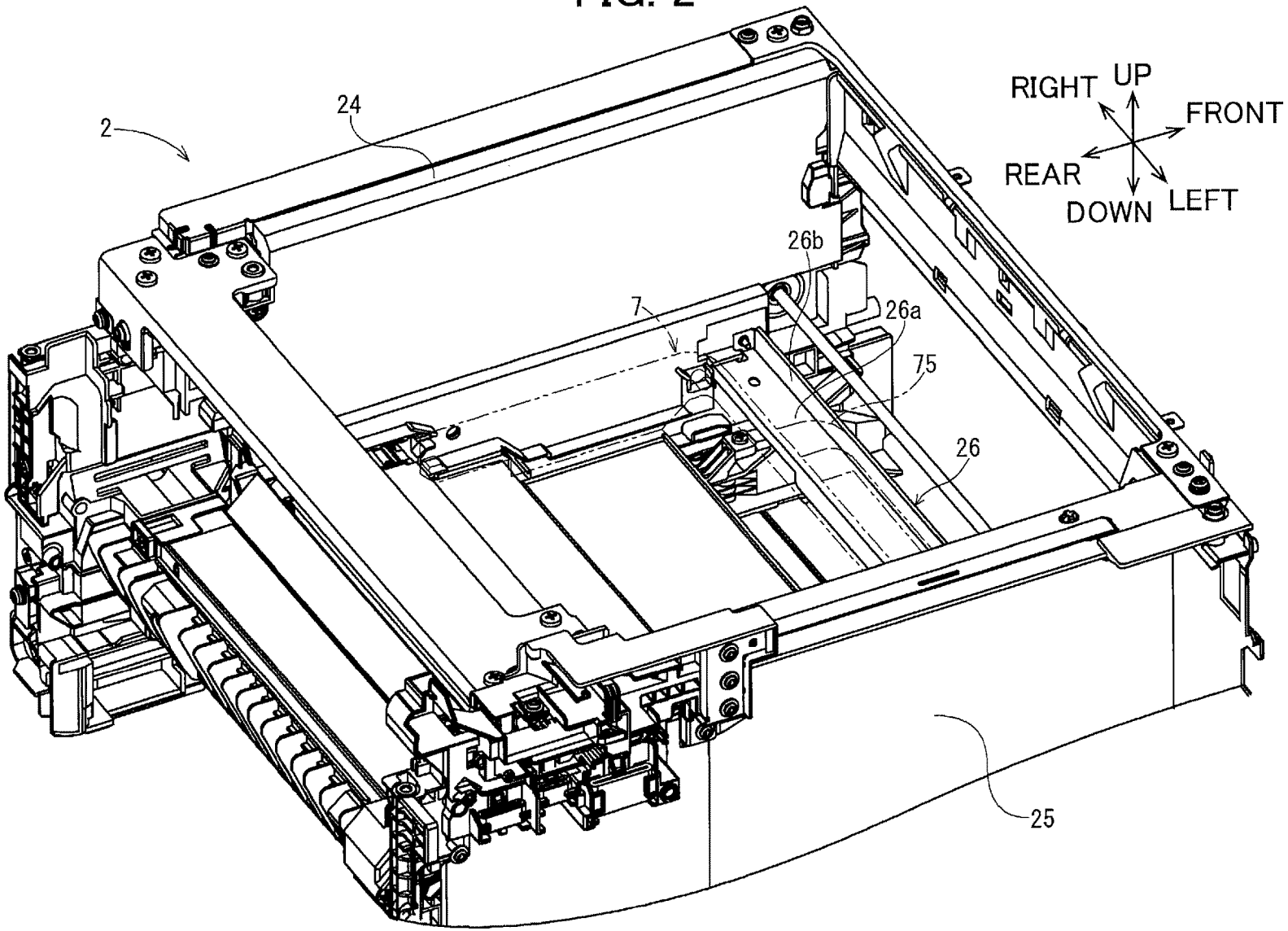
FIG. 2 is a perspective view illustrating a main body.
Figure 3:
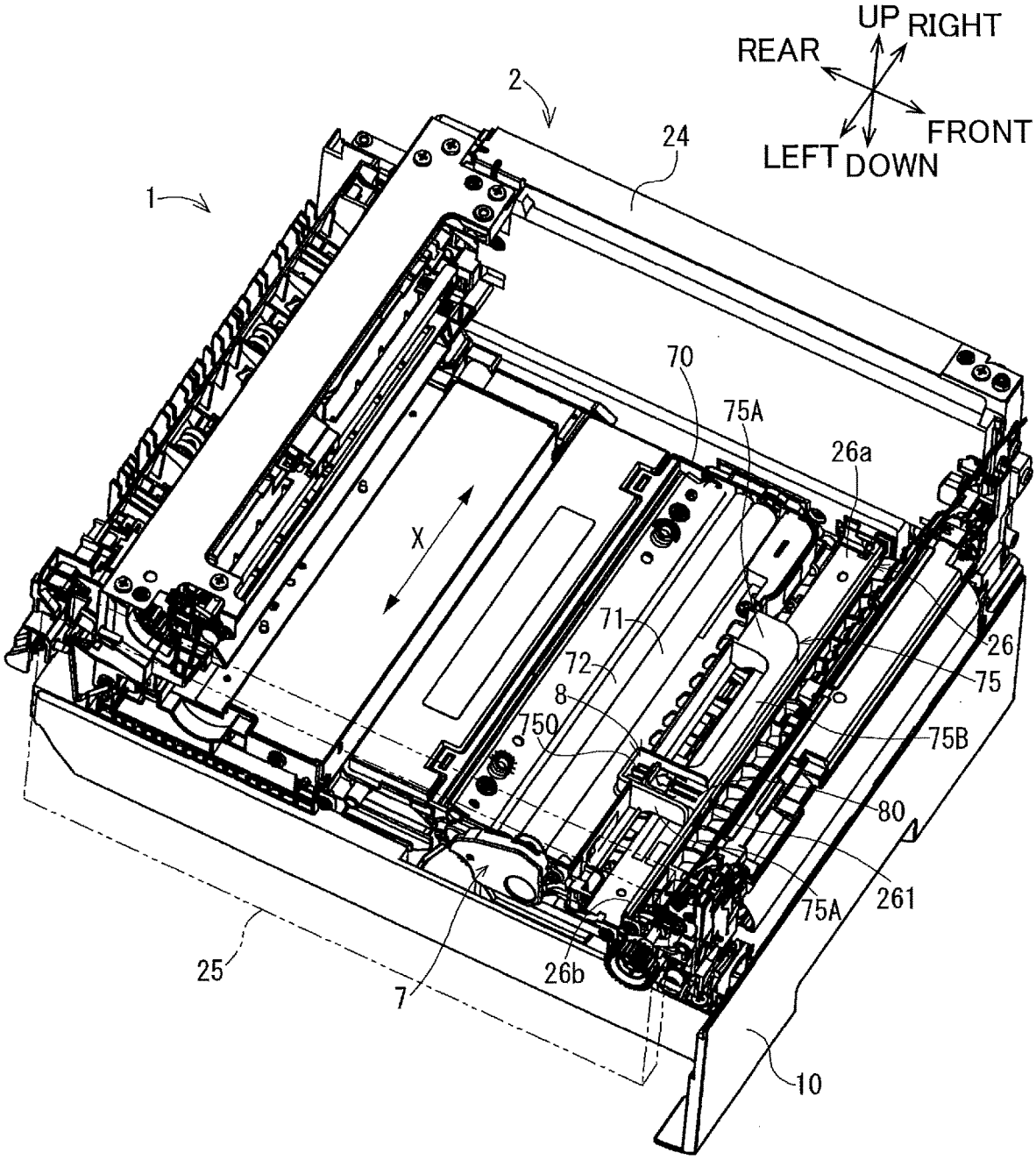
FIG. 3 is a perspective view of the main body to which a cleaning unit is attached.

As illustrated in FIGS. 2 and 3, the main body 2 also includes a first main body frame 24 and a second main body frame 25 those are positioned to be spaced apart from each other in the left-right direction. The first main body frame 24 constitutes a right end portion of the main body 2, and extends in the front-rear direction and an up-down direction. The second main body frame 25 constitutes a left end portion of the main body 2, and extends in the front-rear direction and the up-down direction.

The cleaning unit 7 is disposed between the first main body frame 24 and the second main body frame 25, and detachably supported by the first main body frame 24 and the second main body frame 25.

The main body 2 includes a metal plate member 26 extending in the left-right direction so as to connect the first main body frame 24 and the second main body frame 25 to each other. With this configuration, rigidity of the main body 2 can be enhanced.

The metal plate member 26 includes a horizontal part 26*a* whose plate surfaces face upward and downward, and a vertical part 26*b* formed by bending a front end portion of the horizontal part 26*a* upward and has plate surfaces face frontward and rearward. The vertical part 26*b* is formed with a hole 261 penetrating the vertical part 26*b* in the front-rear direction. The hole 261 is in a form of a rectangular shape elongated in the left-right direction (see FIG. 10).

In a state where the cleaning unit 7 is attached to the main body 2, the horizontal part 26*a* is positioned below the handle 75, and the vertical part 26*b* is positioned frontward of the handle 75.

[Cleaning Unit]

Figure 4:
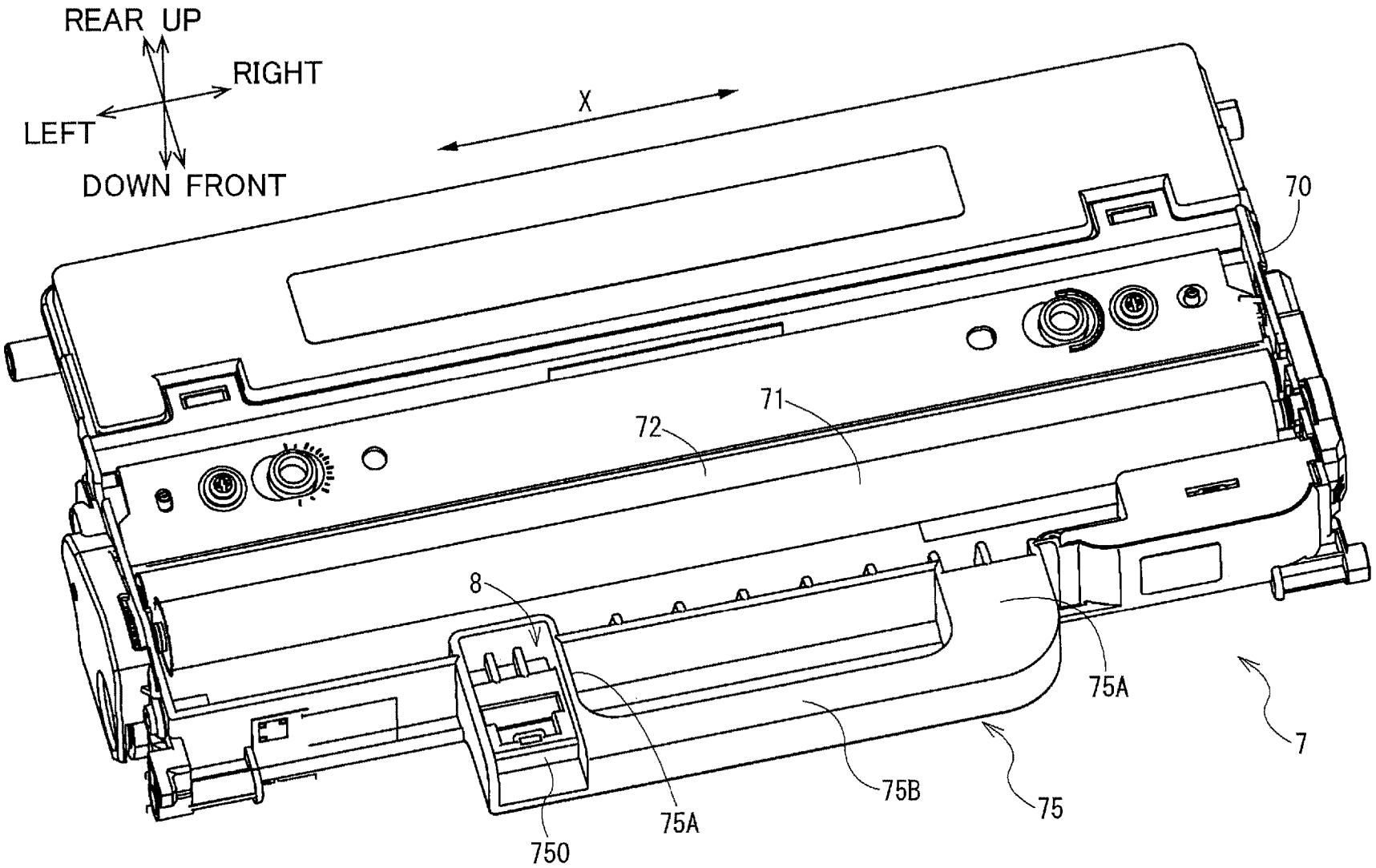
FIG. 4 is a perspective view of the cleaning unit.

As illustrated in FIGS. 3 and 4, each of the belt cleaning roller 71 and the collection roller 72 extends in the left-right direction in a state where the cleaning unit 7 is attached to the main body 2. The handle 75 of the cleaning unit 7 includes a pair of first parts 75A, and a second part 75B.

The first parts 75A are positioned to be spaced apart from each other in the left-right direction, and extend in the front-rear direction. In the present embodiment, each of the first parts 75A extends frontward from a front end portion of the frame 70. The front-rear direction defined in the present embodiment is a direction perpendicular to the axial direction X of the photosensitive drum 51. The second part 75B extends in the axial direction X of the photosensitive drum 51 (i.e., the left-right direction) and connects the first parts 75A to each other. The front-rear direction is an example of an extending direction perpendicular to an axial direction. The front-rear direction is also an example of a first extending direction. The left-right direction is an example of a second extending direction.

The first parts 75A of the handle 75 includes a lock mechanism 8 for locking the cleaning unit 7 to the main body 2. By locking the cleaning unit 7 relative to the main body 2 using the lock mechanism 8, the cleaning unit 7 attached to the main body 2 is reliably fixed relative to the main body 2, whereby detachment of the cleaning unit 7 from the main body 2 can be suppressed. In the present embodiment, the lock mechanism 8 is provided at one of the first parts 75A positioned leftward. However, the lock mechanism 8 may be provided at the remaining one of the first parts 75A, i.e., the first part 75A positioned rightward.

[Lock Mechanism]

Figure 5A:
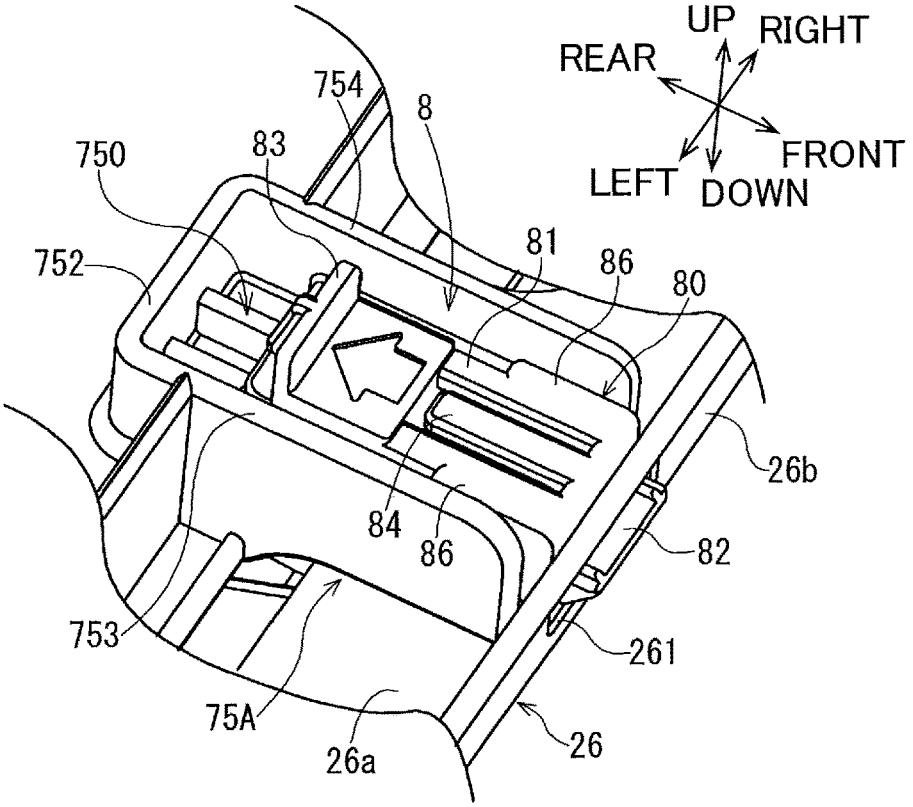
FIG. 5A is a perspective view illustrating a lock mechanism and particularly illustrating a state where a locking member is at its locking position.
Figure 5B:
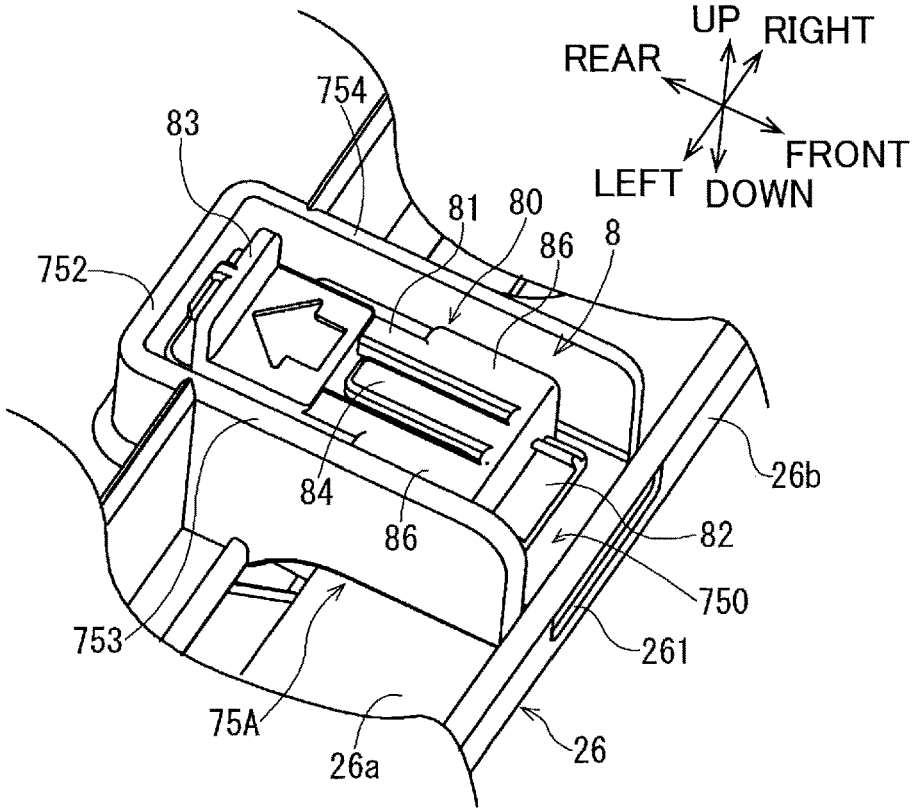
FIG. 5B is a perspective view illustrating the lock mechanism and particularly illustrating a state where the locking member is at its unlocking position.

As illustrated in FIGS. 5A and 5B, the lock mechanism 8 includes a locking member 80, and a lock portion 750. The locking member 80 is slidingly movable in the front-rear direction at the first part 75A of the handle 75 and is engageable with the main body 2. The lock portion 750 is provided at the first part 75A of the handle 75 and supports the locking member 80 such that the locking member 80 is slidingly movable.

Figure 6A:
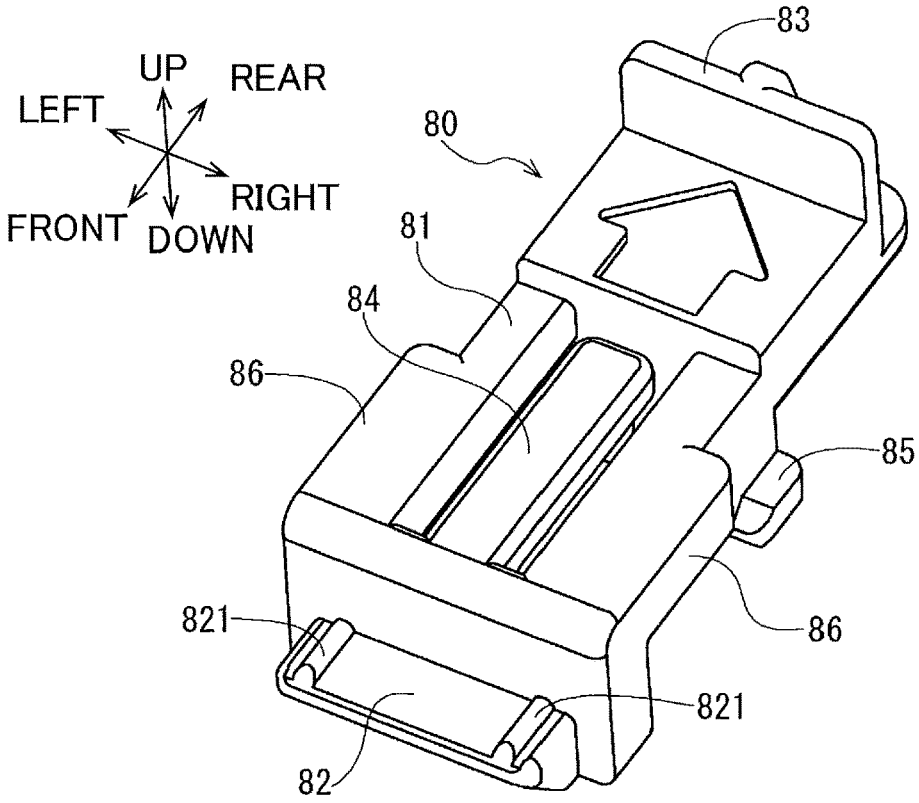
FIG. 6A is a perspective view illustrating the locking member of the lock mechanism.
Figure 6B:
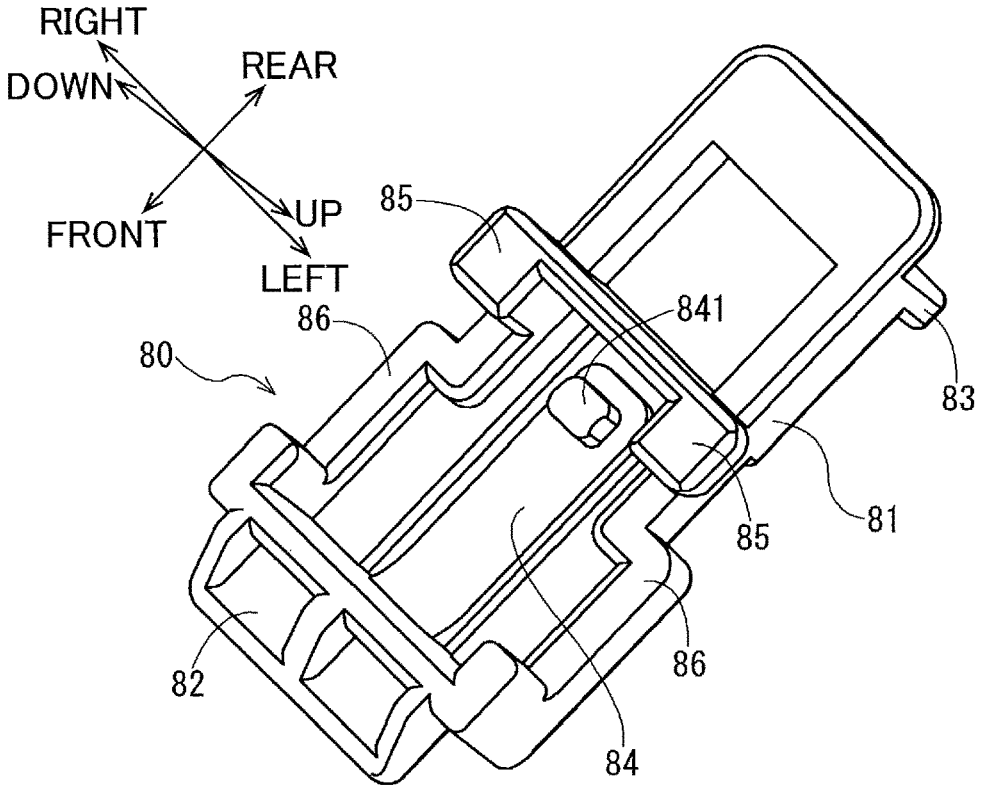
FIG. 6B is another perspective view illustrating the locking member of the lock mechanism.
Figure 7:
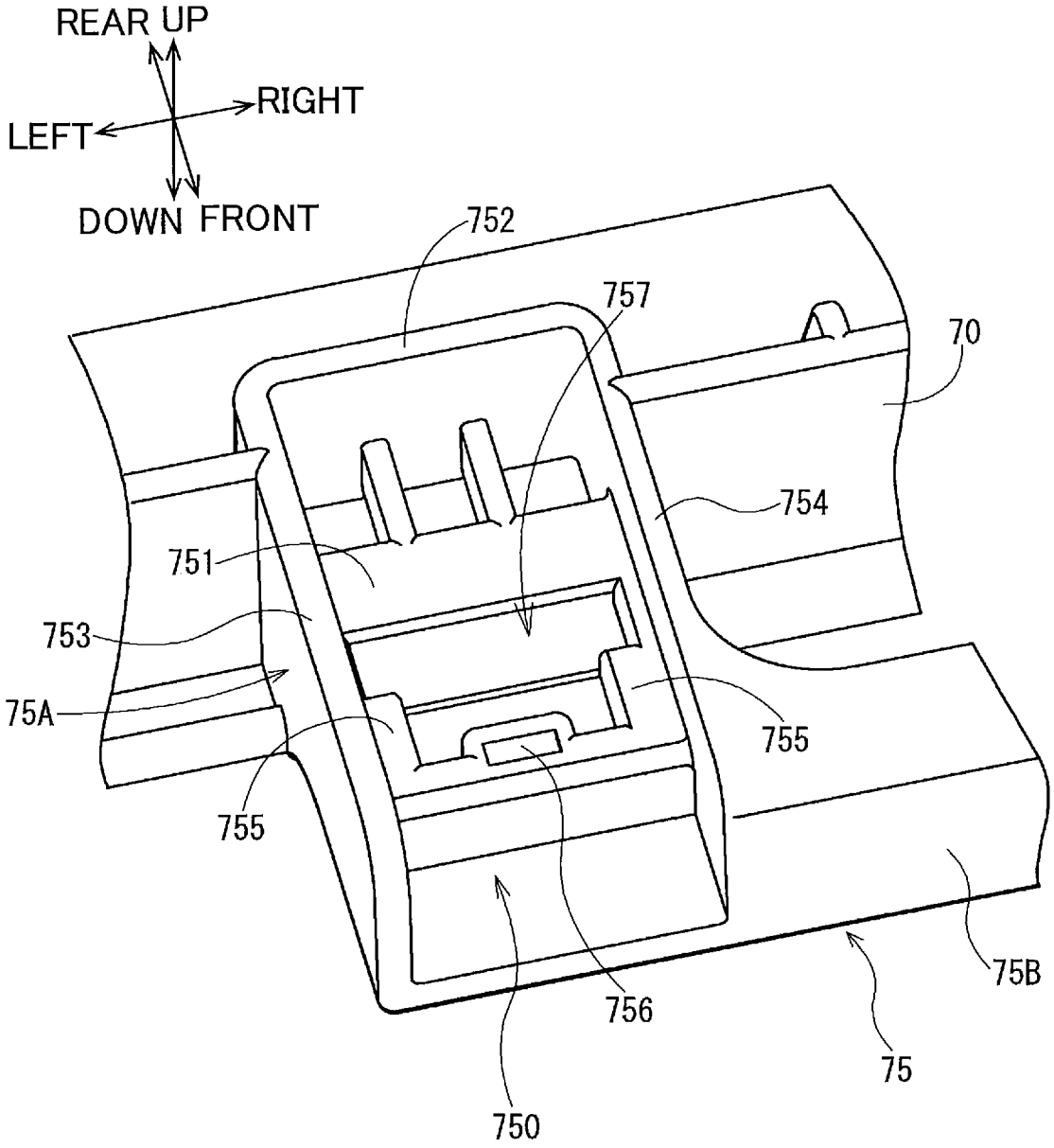
FIG. 7 is a perspective view illustrating a lock portion of the lock mechanism.

As illustrated in FIGS. 6A and 6B, the locking member 80 is in a form of a substantially block-like shape. Specifically, the locking member 80 has a generally plate shape extending both in the front-rear direction and the left-right direction (elongated in the front-rear direction) and having a thickness in the up-down direction. As illustrated in FIG. 7, the lock portion 750 has a generally recessed shape that is recessed downward to receive the locking member 80 therein. The locking member 80 is an example of a locking block. The lock portion 750 is an example of a lock recess.

The locking member 80 is slidingly movable between a lock position (a position illustrated in FIG. 5A) at which the locking member 80 is engaged with the hole 261 formed in the metal plate member 26, and an unlock position (a position illustrated in FIG. 5B) at which the locking member 80 is not engaged with the hole 261. The locking member 80 at the lock position is positioned frontward of the locking member 80 at the unlock position. In the lock mechanism 8, when the locking member 80 is positioned at the lock position, the locking member 80 and the lock portion 750 are engaged with each other.

As the locking member 80 is slidingly moved to the lock position, the locking member 80 is engaged with both the metal plate member 26 and the lock portion 750, whereby the cleaning unit 7 is locked to the main body 2. Further, when the locking member 80 is slidingly moved to the unlock position, the locking member 80 is no longer locked relative to the main body 2, thereby enabling the cleaning unit 7 to be detached from the main body 2.

As illustrated in FIGS. 5A to 6B, the locking member 80 includes a body part 81, an engagement piece 82, a pressure piece 83, an elastic piece 84, a pair of first pinching pieces 85, and a pair of second pinching pieces 86.

The body part 81 is slidably movably supported by the lock portion 750. The engagement piece 82 protrudes frontward from a front end portion of the body part 81. The engagement piece 82 is engaged with the hole 261 of the metal plate member 26 when the locking member 80 is at the lock position. The engagement piece 82 is not engaged with the hole 261 of the metal plate member 26 when the locking member 80 is at the unlock position.

The pressure piece 83 protrudes upward from a rear end portion of the body part 81. The pressure piece 83 is a portion to be pressed in order to slidingly move the locking member 80. For example, as the pressure piece 83 is pressed rearward, the locking member 80 at the lock position can be slidingly moved to the unlock position.

The elastic piece 84 has a bar-like shape extending in the front-rear direction, and has elasticity. The elastic piece 84 has a front end portion (a base end portion) supported by the front end portion of the body part 81, and a rear end portion (a tip end portion) elastically deformable in the up-down direction.

A lock protrusion 841 protrudes downward from a lower surface of the rear end portion of the elastic piece 84. The lock protrusion 841 of the elastic piece 84 is locked to the lock portion 750 when the locking member 80 is at the lock position, thereby retaining the locking member 80 at the lock position.

The pair of first pinching pieces 85 are positioned to be arranged in the left-right direction at a middle portion in the front-rear direction of the body part 81. The first pinching piece 85 positioned leftward protrudes leftward from the body part 81, and the first pinching piece 85 positioned rightward protrudes rightward from the body part 81.

The pair of second pinching pieces 86 are arranged in the left-right direction at positions frontward of the pair of first pinching pieces 85. The second pinching piece 86 positioned leftward protrudes leftward from the body part 81, and the second pinching piece 86 positioned rightward protrudes rightward from the body part 81. Further, the pair of first pinching pieces 85 is positioned at a lower portion of the locking member 80, and the pair of second pinching pieces 86 is positioned further upward than the pair of first pinching piece 85 in the up-down direction.

The first pinching pieces 85 and the second pinching pieces 86 pinch the lock portion 750 therebetween such that the lock portion 750 is slidingly movable relative thereto when the locking member 80 is at the lock position. The first pinching pieces 85 and the second pinching pieces 86 do not pinch the lock portion 750 when the locking member 80 is at the unlock position.

As illustrated in FIGS. 5A, 5B, and 7, the lock portion 750 includes a support part 751, a stopper 752, a first wall 753, a second wall 754, and a pair of pinch parts 755, and has a lock groove 756, and a through-hole 757.

The support part 751 slidingly movably supports the body part 81 of the locking member 80. The stopper 752 constitutes a rear end portion of the lock portion 750, and protrudes further upward than the support part 751.

The stopper 752 is brought into abutment against the locking member 80 when the locking member 80 is slidingly moved to the unlock position to restrict sliding movement of the locking member 80. That is, when the locking member 80 at the lock position is slidingly moved rearward and reaches the unlock position, the locking member 80 abuts against the stopper 752 and further rearward movement thereof is restricted by the stopper 752.

The first wall 753 constitutes a left end portion of the lock portion 750 and protrudes further upward than the support part 751. The first wall 753 is positioned close to a left portion of the locking member 80 supported by the lock portion 750 and restricts displacement in a leftward direction of the locking member 80.

The second wall 754 constitutes a right end portion of the lock portion 750 and protrudes further upward than the support part 751. The second wall 754 is positioned close to a right portion of the locking member 80 supported by the lock portion 750 and restricts displacement in a rightward direction of the locking member 80. The leftward direction is an example of one direction of the axial direction, and the rightward direction is an example another direction of the axial direction. The leftward direction is also an example of one direction of the second extending direction, and the rightward direction is also an example of another direction of the second extending direction.

A rear end of the first wall 753 and a rear end of the second wall 754 are connected to each other through the stopper 752, and rigidity of the lock portion 750 is enhanced by the first wall 753, the second wall 754, and the stopper 752.

The pair of pinch parts 755 is provided to be arranged in the left-rightward direction to constitute the left and right end portions of the lock portion 750. Each of the pinch parts 755 is pinched by the corresponding first pinching piece 85 and second pinching piece 86 when the locking member 80 is slidingly moved to the lock position.

Specifically, the pinch part 755 positioned leftward is pinched between the first pinching piece 85 and the second pinching piece 86 of the locking member 80 those are positioned leftward, and the pinch part 755 positioned rightward is nipped between the first pinching piece 85 and the second pinching piece 86 of the locking member 80 those are positioned rightward. In a state where the pinch parts 755 are pinched between the corresponding first pinching pieces 85 and second pinching pieces 86, engagement between the locking member 80 and the lock portion 750 is established.

The lock groove 756 is formed at an upper surface of the support part 751 to have a groove shape recessed downward. When the locking member 80 is slidingly moved to the lock position and is at the lock position, the lock protrusion 841 of the elastic piece 84 is locked to the lock groove 756.

The through-hole 757 penetrates the lock portion 750 in the up-down direction. The first pinching pieces 85 of the locking member 80 are positioned further downward than the pinch parts 755, and the pair of second pinching pieces 86 of the locking member 80 are positioned further upward than the pinch parts 755. The through-hole 757 is positioned rearward of the pinch parts 755. When the locking member 80 is positioned at the unlock position, the first pinching pieces 85 can pass upward through the through-hole 757 from below.

The up-down direction is an example of a perpendicular direction perpendicular to both the axial direction and the extending direction. The up-down direction is also an example of a perpendicular direction perpendicular to both the first extending direction and the second extending direction. Further, the downward direction is an example of one direction of the perpendicular direction, and the upward direction is an example of another direction of the perpendicular direction.

Figure 8A:
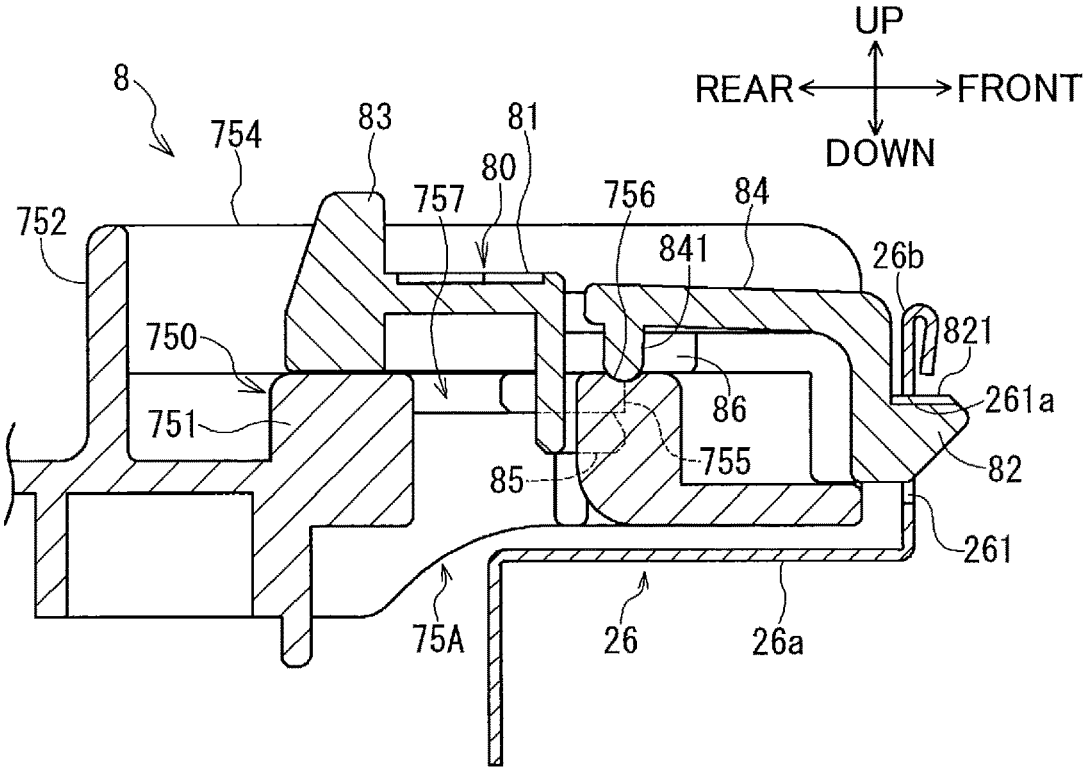
FIG. 8A is a side cross-sectional view illustrating the lock mechanism and particularly illustrating a state where the locking member is at the locking position.
Figure 9:
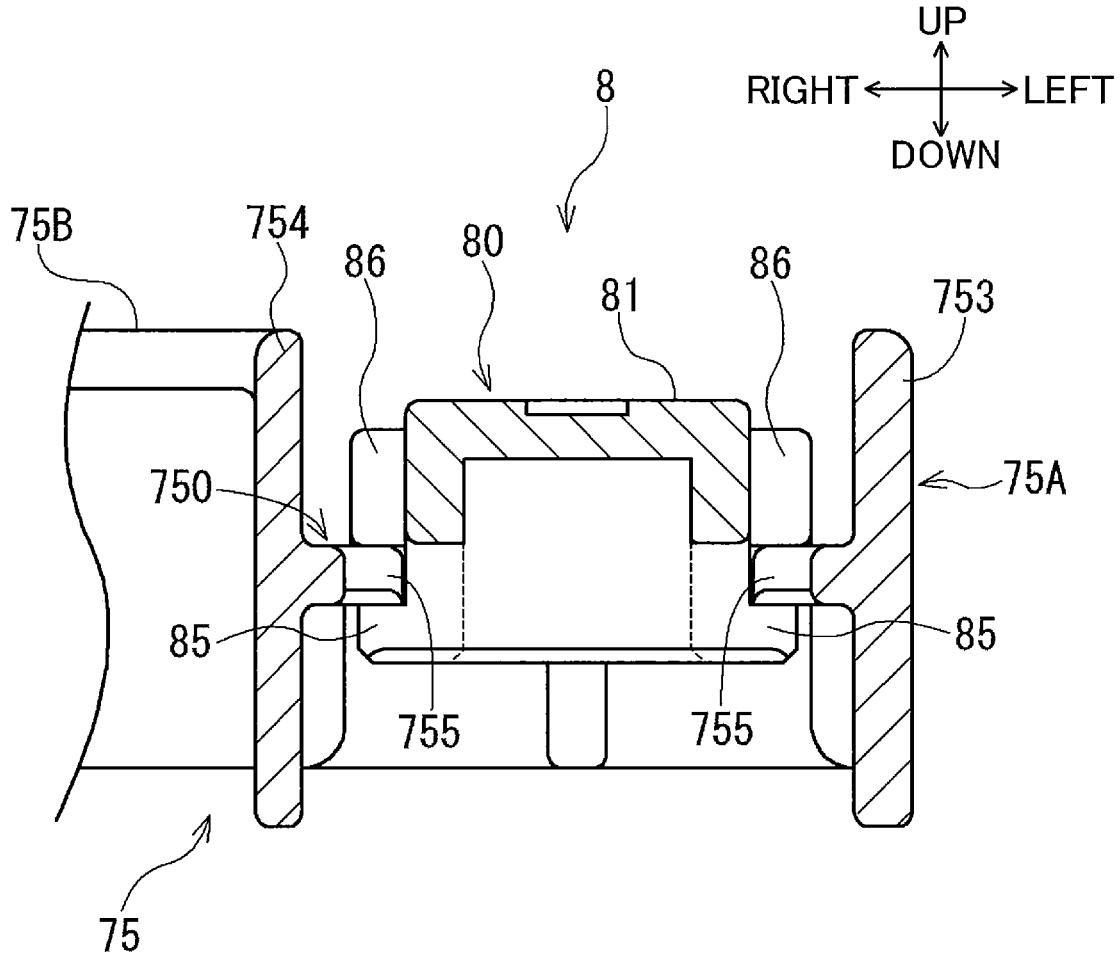
FIG. 9 is rear cross-sectional view illustrating the lock mechanism.

As illustrated in FIGS. 8A and 9, when the locking member 80 is at the lock position in the lock mechanism 8, the engagement piece 82 of the locking member 80 is in engagement with the hole 261 of the metal plate member 26, and the pinch parts 755 of the lock portion 750 are pinched in the up-down direction by the corresponding first pinching pieces 85 and second pinching pieces 86 of the locking member 80. Thus, the cleaning unit 7 and the metal plate member 26 of the main body 2 are connected to each other, whereby the cleaning unit 7 is locked relative to the main body 2.

Accordingly, in the lock mechanism 8, by slidingly moving the locking member 80 to the lock position, the cleaning unit 7 can be easily locked to the main body 2.

Further, as illustrated in FIG. 8A, when the locking member 80 is at the lock position, the lock protrusion 841 of the elastic piece 84 in the locking member 80 is locked to the lock groove 756 of the lock portion 750, thereby restricting sliding movement of the locking member 80 in the front-rear direction relative to the lock portion 750. Accordingly, inadvertent sliding movement of the locking member 80 from the lock position, thereby retaining the cleaning unit 7 at a state where the cleaning unit 7 is locked to the main body 2.

Further, when the lock protrusion 841 of the elastic piece 84 is locked to the lock groove 756 in a state where the locking member 80 is at the lock position, the elastic piece 84 is elastically deformed upward to urge the locking member 80 upward relative to the lock portion 750.

Figure 10:
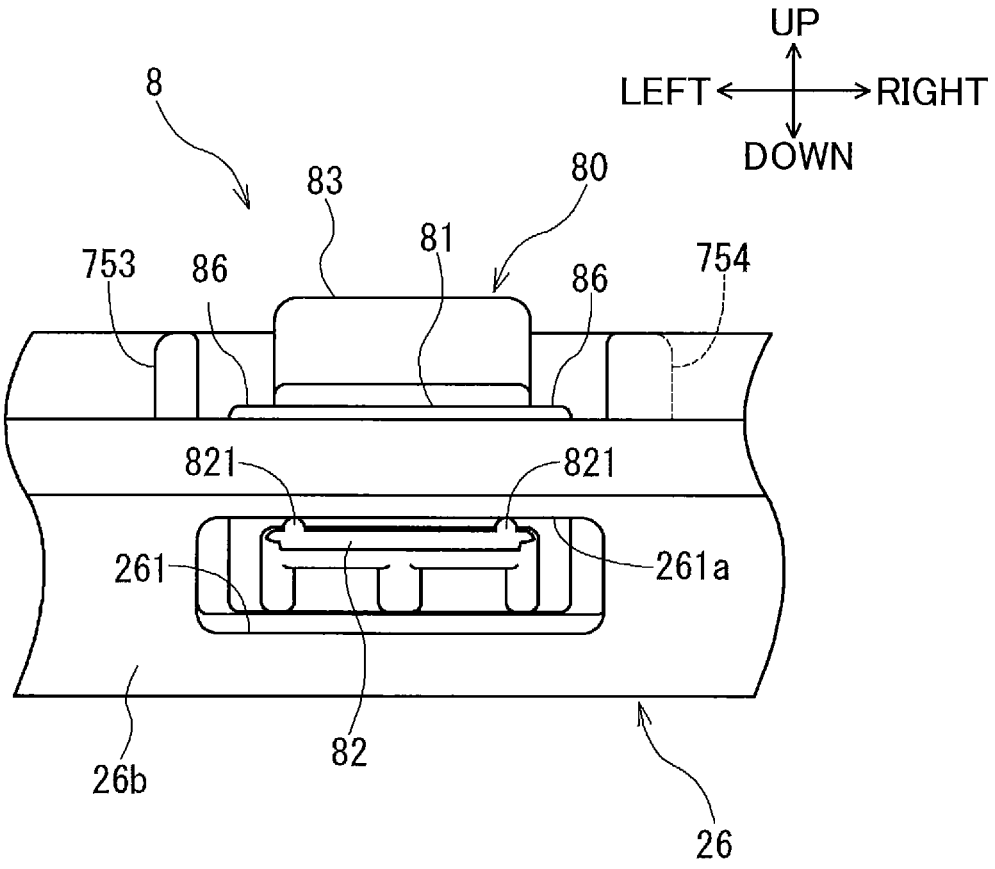
FIG. 10 is a front view illustrating a state where a protrusion of an engagement piece inserted through a hole formed in a metal plate member abuts against an upper portion of a peripheral edge part defining the hole.

As illustrated in FIGS. 8A and 10, the engagement piece 82 of the locking member 80 includes protrusions 821 protruding upward from an upper surface thereof. As the locking member 80 is urged upward, the protrusions 821 of the engagement piece 82 abut against a peripheral edge part 261*a* defining an upper part of the hole 261 of the metal plate member 26.

The protrusions 821 of the engagement piece 82 abut against the peripheral edge part 261*a* at the upper side of the hole 261 of the metal plate member 26 when the locking member 80 is at the lock position, whereby rattling of the cleaning unit 7 relative to the main body 2 can be prevented in a state where the cleaning unit 7 is locked to the main body 2.

Further, in the lock mechanism 8, the locking member 80 is slidingly movable to the unlock position by pressing the pressure piece 83 of the locking member 80 at the lock position rearward.

During this pressure operation, since the first wall 753 of the lock portion 750 is positioned close to the left portion of the locking member 80, and the second wall 754 of the lock portion 750 is positioned close to the right portion of the locking member 80, sliding movement in the front-rear direction of the locking member 80 can be guided by the first wall 753 and the second wall 754, thereby attaining smooth sliding movement of the locking member 80.

When the locking member 80 that has been slidingly moved reaches the unlock position, the locking member 80 abuts against the stopper 752, and further rearward movement of the locking member 80 from the unlock position is restricted. Accordingly, the locking member 80 can be easily stopped at the unlock position. This configuration can restrain further rearward movement of the locking member 80 from the unlock position that may cause contact of the locking member 80 with the belt cleaning roller 71 positioned rearward of the handle 75.

At the time of shipment of the image forming apparatus 1, the cleaning unit 7 is locked to the main body 2 by using the lock mechanism 8. Thereafter, when the waste toner accommodated in the cleaning unit 7 is full, for example, an operator slidingly moves the locking member 80 from the lock position to the unlock position to detach the used cleaning unit 7 from the main body 2, and then attaches a new cleaning unit 7 to the main body 2.

When the operator slidingly moves the locking member 80 from the lock position to the unlock position, the operator grasps the second part 75B of the handle 75. The lock mechanism 8 is provided at the first part 75A of the handle 75, so that the operator's hand is less likely to cover the lock mechanism 8 when the operator grips the second part 75B of the handle 75, thereby achieving smooth operation of the lock mechanism 8 without hindering the sliding movement of the locking member 80 in the lock mechanism 8.

Further, since the locking member 80 can be switched between the lock position and the unlock position just by sliding operation of the locking member 80, operation of locking and unlocking the cleaning unit 7 to and from the main body 2 can be simplified.

Figure 8B:
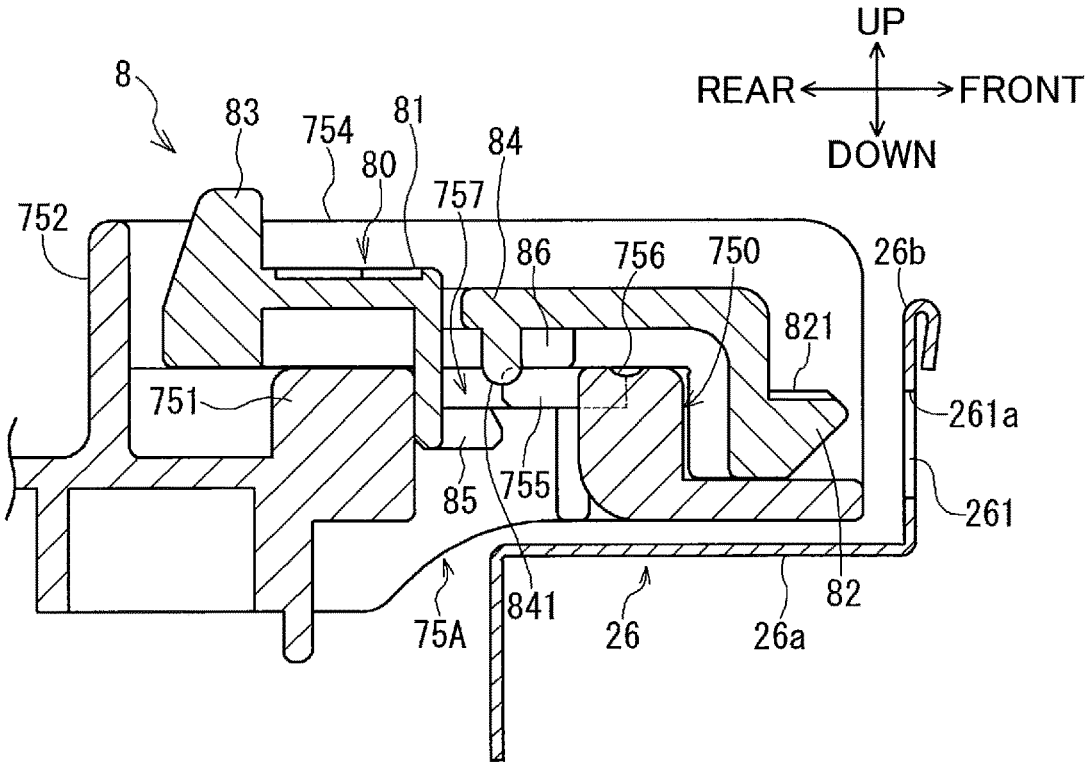
FIG. 8B is a side cross-sectional view illustrating the lock mechanism and particularly illustrating a state where the locking member is at the unlocking position.

As illustrated in FIG. 8B, when the locking member 80 is positioned at the unlock position, the engagement piece 82 of the locking member 80 retracts rearward from the hole 261 of the metal plate member 26 and is not in engagement with the same. Further, although the second pinching pieces 86 of the locking member 80 abut against an upper surface of the corresponding pinch parts 755, the first pinching pieces 85 of the locking member 80 are positioned rearward of the pinch parts 755. That is, the pinch parts 755 are not pinched between the first pinching pieces 85 and the second pinching pieces 86. Thus, the lock state of the cleaning unit 7 relative to the main body 2 by the lock mechanism 8 is released.

Further, when the locking member 80 is positioned at the unlock position, the first pinching pieces 85 of the locking member 80 are disposed at positions where the through-hole 757 of the lock portion 750 is formed in the front-rear direction and can pass upward through the through-hole 757 from below. The locking member 80 can be detached from the lock portion 750 by making the first pinching piece 85 pass upward through the through-hole 757 from below. That is, the locking member 80 is detachably attached to the lock portion 750.

Since the lock portion 750 has the through-hole 757 as described above, the locking member 80 can be easily detached from the lock portion 750 by simply sliding the locking member 80 to the unlock position.

Further since the locking member 80 is attachable to and detachable from the lock portion 750, the locking member 80 can be detached from the used cleaning unit 7 and can be attached to a new cleaning unit 7 when replacing the cleaning unit 7 with a new cleaning unit 7.

The cleaning unit 7 newly attached to the main body 2 in place of the used cleaning unit 7 can be used in a state where the new cleaning unit 7 is not locked relative to the main body 2 by the lock mechanism 8. However, the new cleaning unit 7 can be used in a state where the cleaning unit 7 is locked to the main body 2 by the lock mechanism 8.

In the latter case, in order to attach the locking member 80 to the lock portion 750 of the new cleaning unit 7, the locking member 80 is placed on the lock portion 750 of the cleaning unit 7 so as to be positioned at the unlock position. Then, the pressure piece 83 of the locking member 80 placed on the lock portion 750 is pressed frontward such that the locking member 80 is slidingly moved from the unlock position to the lock position.

As the locking member 80 is slidingly moved to the lock position by the pressure piece 83 being pressed frontward, the engagement piece 82 is brought into engagement with the hole 261 of the metal plate member 26, and the pinch parts 755 of the lock portion 750 are pinched between the corresponding first pinching pieces 85 and second pinching pieces 86, whereby the cleaning unit 7 can be easily locked to the main body 2.

Further, the elastic piece 84 of the locking member 80 is locked to the lock groove 756 of the lock portion 750 as a result of sliding movement of the locking member 80 to the lock position, thereby retaining the lock state of the cleaning unit 7 to the main body 2 using the lock mechanism 8.

What is claimed is:

1. A cleaning unit attachable to and detachable from a main body of an image forming apparatus including a photosensitive drum extending in an axial direction and a belt configured to contact the photosensitive drum, the cleaning unit being capable of accommodating therein developing agent collected from the image forming apparatus, the cleaning unit comprising:

a frame configured to accommodate therein developing agent collected from the image forming apparatus; and a handle comprising a pair of first parts, each of the pair of first parts extending from the frame in an extending direction perpendicular to the axial direction in a state where the cleaning unit is attached to the main body, the pair of first parts comprising a lock mechanism for locking the cleaning unit to the main body; and a second part extending in the axial direction and connecting the pair of first parts to each other, wherein the lock mechanism comprises a looking member that is slidably movable, and a look portion supporting the locking member such that the looking member is slidably movable.

2. The cleaning unit according to claim 1, wherein the locking member is slidingly movable in the extending direction and is engageable with the main body.

3. The cleaning unit according to claim 1, wherein the locking member is attachable to and detachable from the lock portion.

4. The cleaning unit according to claim 1, wherein the locking member is slidingly movable between:

a lock position at which the locking member is engaged with a hole formed in a metal plate member extending in the axial direction and provided at the main body; and an unlock position at which the locking member is not engaged with the hole, and wherein the locking member and the lock portion are engaged with each other when the locking member is at the lock position.

5. The cleaning unit according to claim 4, wherein the locking member comprises:

an engagement piece configured to be engaged with the hole of the metal plate member;

a pressure piece configured to be pressed when the locking member is slidingly moved;

an elastic piece configured to be engaged with the lock portion when the locking member is at the lock position to retain the locking member at the lock position; a first pinching piece; and a second pinching piece, the first pinching piece and the second pinching piece being configured to pinch the lock portion therebetween such that the lock portion is slidingly movable relative thereto when the locking member is at the lock position, the first pinching piece and the second pinching piece being configured not to pinch the lock portion therebetween when the locking member is at the unlock position.

6. The cleaning unit according to claim 5, wherein the engagement piece comprises a protrusion configured to abut against a peripheral edge part defining the hole of the metal plate member when the locking member is at the lock position.

7. The cleaning unit according to claim 5, wherein the lock portion comprises:

a pinch part configured to be pinched by the first pinching piece and the second pinching piece when the locking member is at the lock position; and a lock groove to which the elastic piece is locked when the locking member is at the lock position.

8. The cleaning unit according to claim 7, wherein the lock portion has a through-hole penetrating the lock portion in a perpendicular direction perpendicular to both the axial direction and the extending direction, the first pinching piece being capable of passing through the through-hole when the locking member is at the unlock position, wherein the perpendicular direction includes one direction and another direction opposite the one direction, wherein the first pinching piece is positioned further in the one direction than the pinch part, and wherein the second pinching piece is positioned further in the another direction than the pinch part.

9. The cleaning unit according to claim 4, wherein the axial direction includes one direction and another direction opposite the one direction, and wherein the lock portion comprises a stopper configured to restrict sliding movement of the locking member by abutting against the locking member when the locking member is at the unlock position;

a first wall configured to restrict displacement in the one direction of the locking member, and a second wall configured to restrict displacement in the another direction of the locking member.

10. The cleaning unit according to claim 1, further comprising a cleaning roller supported by the frame and configured to remove developing agent deposited on the belt.

11. An image forming apparatus comprising:

a main body;

a photosensitive drum extending in an axial direction;

a belt configured to contact the photosensitive drum; and a cleaning unit attachable to and detachable from the main body, the cleaning unit comprising a frame configured to accommodate therein developing agent collected from the image forming apparatus, and a handle comprising a pair of first parts, each of the pair of first parts extending from the frame in an extending direction perpendicular to the axial direction in a state where the cleaning unit is attached to the main body, the pair of first parts comprising a lock mechanism for locking the cleaning unit to the main body, and a second part extending in the axial direction and connecting the pair of first parts to each other, wherein the lock mechanism comprises a locking member that is slidingly movable, and a lock portion supporting the locking member such that the locking member is slidingly movable.

12. A cleaning unit attachable to and detachable from a main body of an image forming apparatus, the cleaning unit being capable of accommodating therein developing agent collected from the image forming apparatus, the cleaning unit comprising:

a frame configured to accommodate therein developing agent collected from the image forming apparatus; and a handle comprising a pair of first parts, each of the pair of first parts extending from the frame in a first extending direction in a state where the cleaning unit is attached to the main body, the pair of first parts comprising a locking block for locking the cleaning unit to the main body, and a second part extending in a second extending direction perpendicular to the first extending direction and connecting the pair of first parts to each other, wherein the locking block is slidingly movable, and wherein the image forming apparatus further comprises a lock recess having a recessed shape and supporting the looking block such that the looking block is slidingly movable.

13. The cleaning unit according to claim 12, wherein the locking block has a substantially block-like shape extending in the first extending direction and the second extending direction, the locking block being slidingly movable in the first extending direction and engageable with the main body.

14. The cleaning unit according to claim 12, wherein the locking block is attachable to and detachable from the lock recess.

15. The cleaning unit according to claim 12, wherein the locking block is slidingly movable between:

a lock position at which the locking block is engaged with a hole formed in a metal plate member extending in the second extending direction and provided at the main body; and an unlock position at which the locking block is not engaged with the hole, and wherein the locking block and the lock recess are engaged with each other when the locking block is at the lock position.

16. The cleaning unit according to claim 15, wherein the locking block comprises:

an engagement piece configured to be engaged with the hole of the metal plate member;

a pressure piece configured to be pressed when the locking block is slidingly moved;

an elastic piece configured to be engaged with the lock recess when the locking block is at the lock position to retain the locking block at the lock position;

a first pinching piece; and a second pinching piece, the first pinching piece and the second pinching piece being configured to pinch the lock recess therebetween such that the lock recess is slidingly movable relative thereto when the locking block is at the lock position, the first pinching piece and the second pinching piece being configured not to pinch the lock recess therebetween when the locking block is at the unlock position.

17. The cleaning unit according to claim 16, wherein the engagement piece comprises a protrusion configured to abut against a peripheral edge part defining the hole of the metal plate member when the locking block is at the lock position.

18. The cleaning unit according to claim 16, wherein the lock recess comprises:

a pinch part configured to be pinched by the first pinching piece and the second pinching piece when the locking block is at the lock position; and a lock groove to which the elastic piece is locked when the locking block is at the lock position.

19. The cleaning unit according to claim 18, wherein the lock recess has a through-hole penetrating the lock recess in a perpendicular direction perpendicular to both the first extending direction and the second extending direction, the first pinching piece being capable of passing through the through-hole when the locking block is at the unlock position, wherein the perpendicular direction includes one direction and another direction opposite the one direction, wherein the first pinching piece is positioned further in the one direction than the pinch part, and wherein the second pinching piece is positioned further in the another direction than the pinch part.

20. The cleaning unit according to claim 15, wherein the second extending direction includes one direction and another direction opposite the one direction, and wherein the lock recess comprises a stopper configured to restrict sliding movement of the locking block by abutting against the locking block when the locking block is at the unlock position, a first wall configured to restrict displacement in the one direction of the locking block, and a second wall configured to restrict displacement in the another direction of the locking block.

* * * * *